US008499766B1

(12) United States Patent
Newton

(10) Patent No.: US 8,499,766 B1
(45) Date of Patent: Aug. 6, 2013

(54) ELECTRONIC CIGARETTE WITH FUNCTION ILLUMINATOR

(76) Inventor: Kyle D. Newton, North Richland Hills, TX (US)

( * ) Notice: Subject to any disclaimer, the term of this patent is extended or adjusted under 35 U.S.C. 154(b) by 472 days.

(21) Appl. No.: 12/882,293

(22) Filed: Sep. 15, 2010

(51) Int. Cl.
*A24F 47/00* (2006.01)

(52) U.S. Cl.
USPC ..... 131/273

(58) Field of Classification Search
None
See application file for complete search history.

(56) References Cited

U.S. PATENT DOCUMENTS

| | | | | |
|---|---|---|---|---|
| 5,060,671 | A * | 10/1991 | Counts et al. | 131/329 |
| 7,726,320 | B2 | 6/2010 | Robinson et al. | |
| 2005/0016550 | A1 | 1/2005 | Katase | |
| 2006/0196518 | A1 | 9/2006 | Hon | |
| 2007/0267031 | A1 | 11/2007 | Hon | |
| 2009/0095311 | A1 | 4/2009 | Han | |
| 2010/0031967 | A1 | 2/2010 | Inagaki | |

* cited by examiner

*Primary Examiner* — Michael J Felton
(74) *Attorney, Agent, or Firm* — Dan Brown Law Office; Daniel R. Brown

(57) ABSTRACT

An electronic cigarette with an illumination function, and that generates an aerosol of a fluid when air is drawn through it, includes a housing with a translucent tip, a mouthpiece, and a battery. A fluid reservoir and an atomizer assembly selectively generate an aerosol of the fluid. A draw pressure sensor generates a draw signal in response to a pressure change induced while air is drawn out of the mouthpiece. A draw control circuit activates the atomizer assembly in response to the draw signal. The draw circuit also outputs a lamp signal in response to the draw signal. A lamp circuit with an actuator, a first color lamp, and a second color lamp that are both aligned to illuminate the tip. The lamp circuit selectively, and alternatively in response to subsequent actuations of the actuator, selects between illuminating the first color lamp and the second color lamp in response to the lamp signal.

13 Claims, 5 Drawing Sheets

Fig. 2c
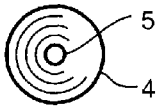
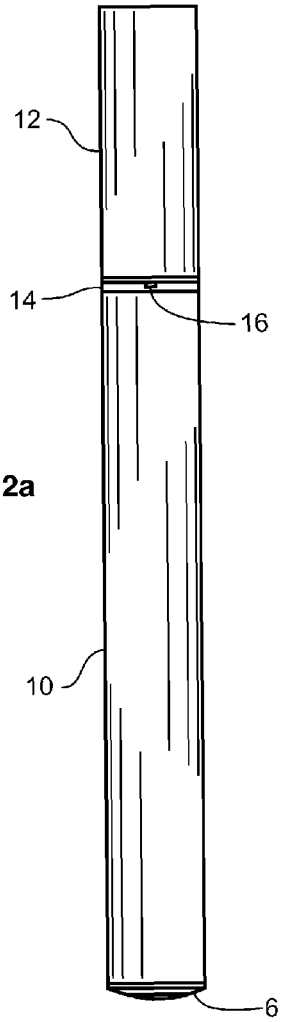
Fig. 2a
Fig. 2b
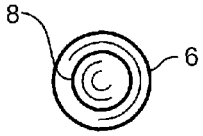
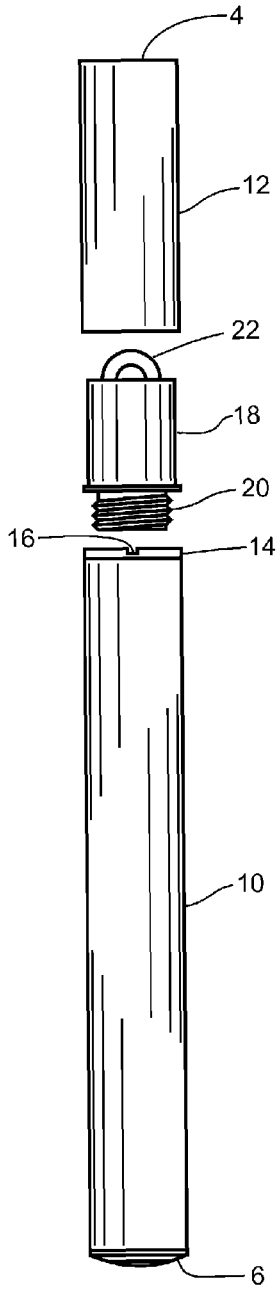
Fig. 3

ELECTRONIC CIGARETTE WITH FUNCTION ILLUMINATOR

BACKGROUND OF THE INVENTION

1. Field of the Invention

The present invention relates to electronic cigarettes. More specifically, the present invention relates to an electronic cigarette with a user selectable illuminated function indicator.

2. Description of the Related Art

Electronic cigarettes have become increasingly popular recently. Electronic cigarettes emulate a tobacco cigarettes, but without the combustion of tobacco during use. Rather than burning tobacco, a fluid is atomized within the electronic cigarette, which emulates the smoke produced in a tobacco cigarette. The fluid may contain flavoring agents such as tobacco flavor, menthol, and others, to enhance the "smoking" experience of the electronic cigarette. Nicotine has been added to the atomization fluid in prior art electronic cigarettes. Since electronic cigarettes are not real cigarettes, they can be enjoyed in designated non-smoking areas, which are increasingly common.

With respect to the similarities between electronic cigarettes and conventional tobacco cigarettes, the design of electronic cigarettes have been tailored to very closely emulate a tobacco cigarette, including flavoring agents, size, shape, and external appearance. Such a design corresponds rather closely in appearance and function to the experience of using tobacco cigarettes. In fact, electronic cigarettes are known that incorporate an amber lamp in the tip end that glows when air is drawn through the electronic cigarette. Thus, the electronic cigarette looks and handles very similarly to a tobacco cigarette, which provides familiarity and comfort to the user. On the other hand, since an electronic cigarette also looks just like a tobacco cigarette to others in the vicinity of the electronic cigarette user. This can be somewhat problematic where a third party may approach an electronic cigarette user with concerns about its use in a designated non-smoking environment. Thus, it can be appreciated that there is a need in the art for an electronic cigarette that provides a nearly identical user experience as the tobacco cigarette when desired, but that also overcomes the aforementioned problems in the art.

SUMMARY OF THE INVENTION

The need in the art is addressed by the apparatus of the present invention. The present invention teaches an electronic cigarette apparatus for generating an aerosol of a fluid in response to air being drawn therethrough. The apparatus includes a housing with a translucent tip, a mouthpiece with an aerosol outlet, and an electric power supply disposed therein. The apparatus further includes a fluid reservoir, for containing the fluid, and an atomizer assembly that receive the fluid from the fluid reservoir, and that selectively generates an aerosol of the fluid. A draw pressure sensor is pneumatically coupled to generate a draw signal in response to detection of a pressure change induced while air is drawn out of the aerosol outlet. A draw control circuit activates the atomizer assembly in response to the draw signal, thereby selectively outputting the aerosol to the aerosol output. The draw circuit also outputs a lamp signal in response to the draw signal. The apparatus also includes a lamp circuit with an actuator, a first color lamp, and a second color lamp, which are both aligned to illuminate the tip. The lamp circuit operates to selectively, and alternatively in response to subsequent actuations of the actuator, select between illuminating the first color lamp and the second color lamp in response to the lamp signal.

In a specific embodiment of the foregoing apparatus, the lamp circuit further operates to selectively, and alternatively in response to subsequent actuations of the actuator, select between not illuminating and illuminating the first color lamp or the second color lamp in response to the lamp signal.

In a specific embodiment, the foregoing apparatus further includes a secondary function circuit that outputs a secondary signal to the lamp circuit, and the lamp circuit illuminates the first color lamp or the second color lamp in response to the secondary signal. In a refinement to this embodiment, where the power supply is a rechargeable battery, the secondary signal indicates low batter power status or battery charging status.

In a specific embodiment of the foregoing apparatus, the lamp circuit also operates to selectively, and alternatively in response to subsequent actuations of the actuator, select between not illuminating and illuminating the first color lamp or the second color lamp in response to the lamp signal. The apparatus also includes a secondary function circuit that outputs a secondary signal to the lamp circuit. And, the lamp circuit illuminates the first color lamp or the second color lamp in response to the secondary signal regardless of state of the lamp signal and the selective and alternative actuator selection.

In a specific embodiment of the foregoing apparatus, the actuator is a second portion of the tip. In a refinement to this embodiment, the actuator is translucent.

In a specific embodiment of the foregoing apparatus, the first color lamp and the second color lamp are light emitting diodes. In another specific embodiment, the first color lamp comprises plural amber color light emitting diodes, and the second color lamp comprises plural light emitting diodes of a color other than amber.

The present invention also teaches an electronic cigarette apparatus for generating an aerosol of a fluid in response to air being drawn therethrough. The apparatus includes a housing with a translucent tip, a mouthpiece with an aerosol outlet, and an electric power supply disposed therein. The apparatus also includes a fluid reservoir, for containing the fluid, and an atomizer assembly that is coupled to receive the fluid from the fluid reservoir, and that selectively generates an aerosol of the fluid. A draw pressure sensor is pneumatically coupled to generate a draw signal in response to detection of a pressure change induced while air is drawn out of the aerosol outlet. A draw control circuit activates the atomizer assembly in response to the draw signal, thereby selectively outputting the aerosol to the aerosol output. The draw control circuit also outputs a lamp signal in response to the draw signal. The apparatus also includes a lamp circuit with an actuator and a first color lamp that is aligned to illuminate the tip. The lamp circuit selectively, and alternatively in response to subsequent actuations of the actuator, selects between not illuminating and illuminating the first color lamp in response to the lamp signal.

In a specific embodiment, the foregoing apparatus further includes a secondary function circuit that outputs a secondary signal to the lamp circuit, and, the lamp circuit further operates to illuminate the first color lamp in response to the secondary signal regardless of state of the lamp signal and the selective and alternative actuator selection. In another specific embodiment of the foregoing apparatus, the actuator is a second portion of the tip. In a refinement to this embodiment, the actuator is translucent. In another specific embodiment, the first color lamp is a light emitting diode. And, in another embodiment, the first color lamp comprises plural amber light emitting diodes.

BRIEF DESCRIPTION OF THE DRAWINGS

FIGS. 2*a*, 2*b*, and 2*c* are side view, tip end view, and mouthpiece end view, respectively, drawings of an electronic cigarette according to an illustrative embodiment of the present invention.

FIG. 3 is an exploded view drawing of an electronic cigarette according to an illustrative embodiment of the present invention.

DESCRIPTION OF THE INVENTION

Figure 1:
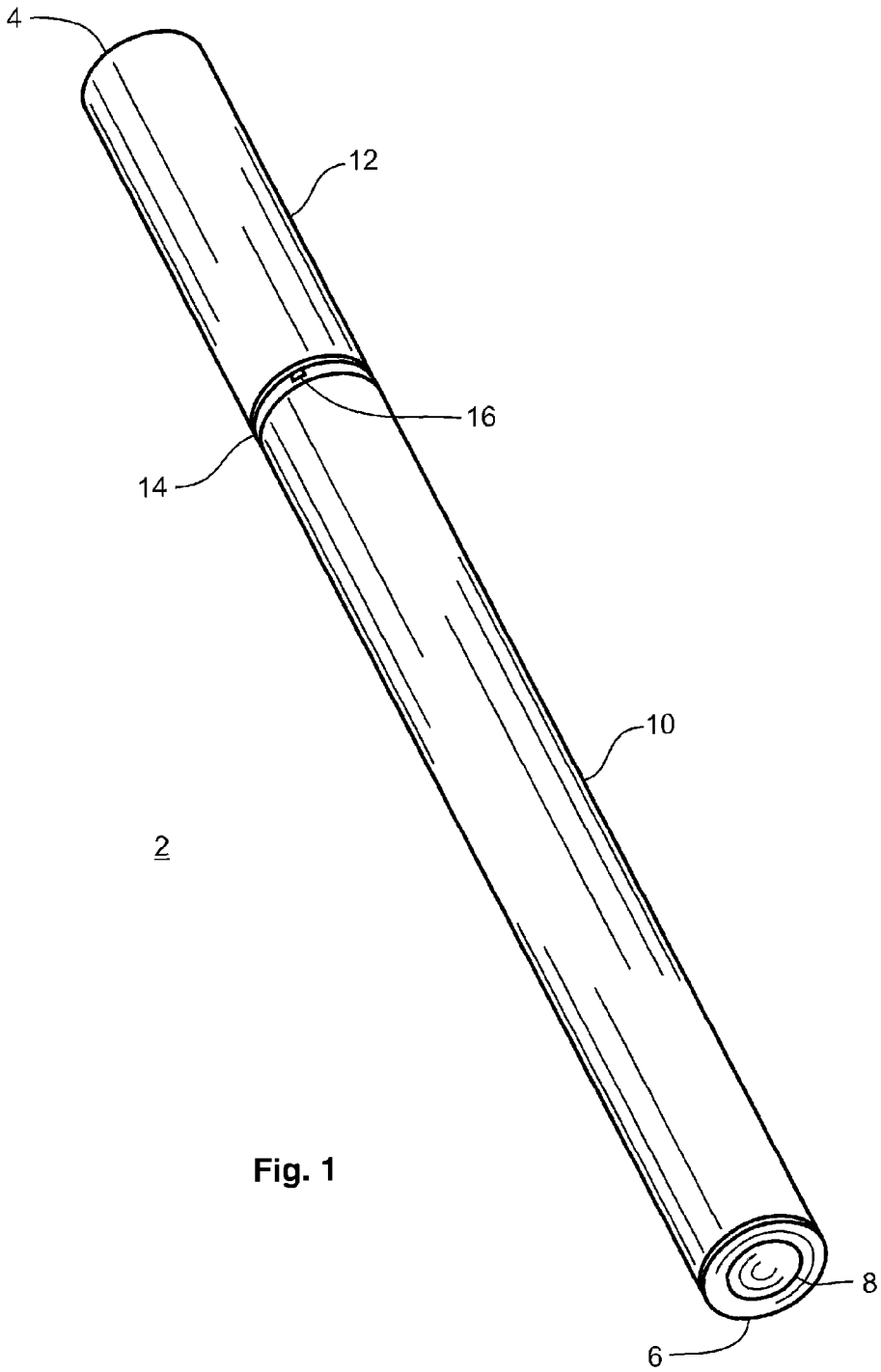
FIG. 1 is a perspective view drawing of an electronic cigarette according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The present invention advances the art of electronic cigarettes by providing a user actuated actuator to control and alter the illumination functions. As has bee noted hereinbefore, it is known in the art to provide an amber lamp at the tip end of an electronic cigarette to emulate the appearance of the glowing ash in a tobacco cigarette. This functionality enhances the similarities between an electronic cigarette and a tobacco cigarette, which is desirable in certain situations. The amber lamp also provides an indication to the user that the electronic cigarette is functioning and has adequate battery power. On the other hand, the amber lamp causes an impression to others that the user is smoking a tobacco cigarette, which is problematic in certain environments, such as designated non-smoking areas. Also, the amber lamp draws attention toward the user of the electronic cigarette, which may not be desirable in certain situations. The present invention employs a lamp circuit to enable the user to select between two or more color lamps, and also the option to not illuminate the lamp when so desired.

Reference is directed to FIG. 1 is a perspective view drawing of an electronic cigarette 2 according to an illustrative embodiment of the present invention. The electronic cigarette 2 comprises a housing having a first elongated portion 10 and a second elongated portion 12. The second elongated portion 12, also referred to as the "cartridge" in certain illustrative embodiments, comprises a mouthpiece end 4, which has an aerosol outlet (not shown) for drawing air through the cartridge 12. The first elongated portion 10 and the second elongated portion 12 are removable joined together with a mechanical coupler 14. One or more air inlet vents 16 are provided about the coupler 14 for allowing airflow into the cartridge 12 when the user draws air through the electronic cigarette 2. The first elongated portion 10 comprises a tip end 6, which is fabricated from a translucent material enabling the transmission of light therethrough. An actuator 8 is disposed as a portion of the tip end 8, which couples to an electrical switch inside the second elongated portion 10, for enabling the user to select various modes of operation of the illuminating functions, as will be more fully described hereinafter.

Now, considering FIGS. 2*a*, 2*b*, and 2*c*, these are side view, tip end view, and mouthpiece end view, respectively, drawings of the electronic cigarette 2 according to an illustrative embodiment of the present invention. Note that the first elongated portion 10 and second elongated portion 12 combine at coupler 14 to present a complete electronic cigarette 2 that closely resembles a tobacco cigarette. The cartridge 12 is fabricated from a material resembling the filter of a tobacco cigarette, and the first elongated portion 10 is fabricated to resemble the tobacco roll of a tobacco cigarette. The mouthpiece end 4 includes an aerosol outlet opening 5, for drawing air and aerosol out of the cartridge 12. Air is inlet to the electronic cigarette 2 at the vent openings 16 located at the coupler 14. The air inlet openings 16 can be located elsewhere on the electronic cigarette 2, and is a matter of design choice. In the illustrative embodiment, the tip end 6 is a translucent gray material resembling an ash, and so too is the actuator 8, which is located concentric to the tip end 6. Note that the actuator 8 could also be located elsewhere on the electronic cigarette 2, and is a matter of design choice.

Reference is directed to FIG. 3, which is an exploded view drawing of the electronic cigarette 2 according to an illustrative embodiment of the present invention. The exploded view presents further details of the structure. The cartridge 12 is withdrawn from an atomizer assembly 18. The engagement between them is by friction fit, allowing the user to replace the cartridge 12 from time to time. The atomizer assembly 18 includes a protuberance 22 and a threaded extension 20 for engaging the coupler 14 in the first elongated portion 10. The protuberance 22 absorbs fluid from the cartridge 12 and atomizes it as air is drawn out of the tip end 4. The threaded extension 20 removably engages the coupler 14. The first elongated portion 10 encloses a power supply, in the form of a rechargeable battery (not shown) and also electronic circuits (not shown), including a draw circuit, a lamp circuit, and a secondary function circuit. The lamp circuit illuminates the tip end 6, providing various visual indications about the operation of the electronic cigarette 2.

Figure 4C:
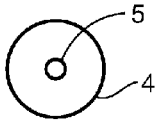
FIGS. 4*a*, 4*b*, and 4*c* are side section view, tip end view, and mouthpiece end view, respectively, drawings of an electronic cigarette according to an illustrative embodiment of the present invention.
Figure 4A:
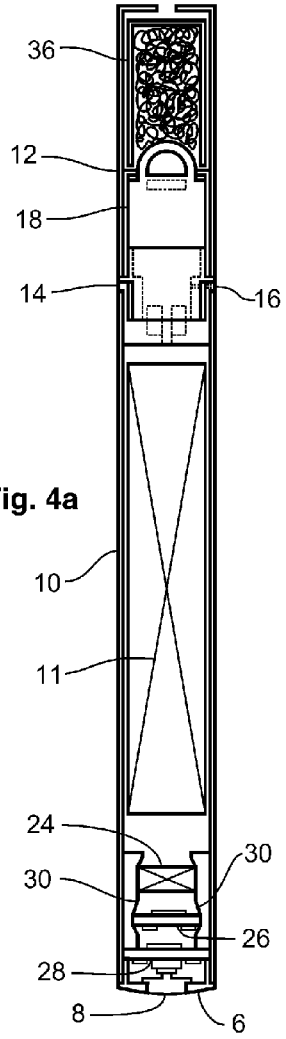
Figure 4B:
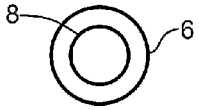
Figure 5:
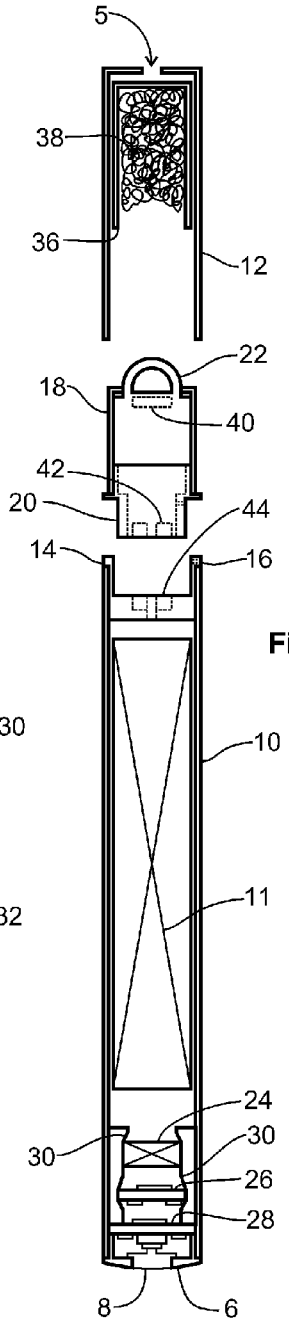
FIG. 5 is an exploded side section view drawing of an electronic cigarette according to an illustrative embodiment of the present invention.

Reference is directed to FIGS. 4*a*, 4*b*, and 4*c*, which are side section view, tip end view, and mouthpiece end view, respectively, drawings of an electronic cigarette according to an illustrative embodiment of the present invention. FIG. 5 is an exploded view drawing illustrating the separated components of the same illustrative embodiment. The cartridge 12 removably engages the atomizer assembly 18. The cartridge contains a fluid reservoir 36 that retains a quantity of the fluid to be atomized in an absorbent porous substrate 38, which may be polyester fiber or other suitable absorbent material known to those skilled in the art. There is an open channel between the fluid reservoir 36 and the cartridge 12 to enable air and atomized aerosol to pass through and out the aerosol outlet 5. When the cartridge 12 is engaged with the atomizer assembly 18, the substrate 38 engages the protuberance 22 of the atomizer assembly such that the fluid wicks over to the atomizer assembly protuberance 22 by capillary action. A heater element 40 in the atomizer assembly 18 is energized while air is drawn through the cartridge, and the heat produces the desired aerosol of the fluid. Other mechanisms for producing an aerosol of a fluid may be employed, as are known to those skilled in the art. Fresh air is inlet to the atomizer assembly 18 through vent openings 16.

The action of drawing air and aerosol out of the aerosol outlet 5 creates a negative pressure in the interior of the cartridge 12 and the atomizer assembly 18. The threaded extension 20 of the atomizer assembly 18 includes an open portion that engages a corresponding open portion in the coupler 14 of the first elongated portion 10. In this manner, the negative pressure of the draw action is pneumatically coupled to the interior of the first elongated portion. This is significant because a draw pressure sensor 24 is disposed in the interior of the first elongated portion to detect that action of the user's draw of air out of the aerosol outlet 5. In addition, the threaded extension 20 and coupler 14 are arranged to provide two separate and insulated electrical coupling paths via contacts 42 and 44, respectively. This electrical path delivers power to energize the heater 40 while the user draw air out of the aerosol outlet 5. The first elongated portion 10 houses an electric power supply 11, which stores a reserve of electric power to operate the circuits of the apparatus. A capacitor or battery are suitable choices for the electrical power supply 11. In the illustrative embodiment, a rechargeable lithium ion battery provides the power source 11.

The elongated portion 10 also houses the main circuit board 26 and the lamp circuit 28. These are aligned adjacent to the draw pressure sensor 24, and are retained in position by compression fit using a resilient polymeric surround 30. The polymeric surround 30 also acts as a pressure seal to insure the draw pressure sensor 24 is properly coupled to detect the negative pressure of the draw. Draw pressure sensors are known to those skilled in the art, and generally provided a signal indicating that a threshold pressure differential has been detected, which is coupled to the draw control circuit of the main circuit board 26. The main circuit board 26 supports the various electronic components of the circuits described herein. In the illustrative embodiment, a simple microprocessor is employed, together with software, to embody the functions described herein. Those skilled in the art are familiar with such embedded processors and programming. The functions of the draw control circuit are to detect the draw action using the draw pressure sensor, generate a signal to energize the atomizer assemble, and generate a lamp signal in response to the draw detection. Essentially, the lamp signal goes active to indicate that the draw action is occurring and that the atomizer is active. Further aspects of these operations will be more fully discussed hereinafter.

The main circuit board 26 also embodies a secondary function circuit, which may share electronic components with the draw control circuit, such as the microprocessor and peripheral components. The secondary function circuit in the illustrative embodiment controls battery recharging, including indications of low battery, charging battery, battery charged, and other functions. The secondary function circuit also outputs a secondary signal to the lamp circuit, so that the lamp, or lamps, may be used to indicate status of the secondary functions. The lamp circuit 28 is positioned adjacent to the tip 6 in the illustrative embodiment. The actuator 8 of the tip 6 actuates the lamp circuit 6 functions.

Figure 6:
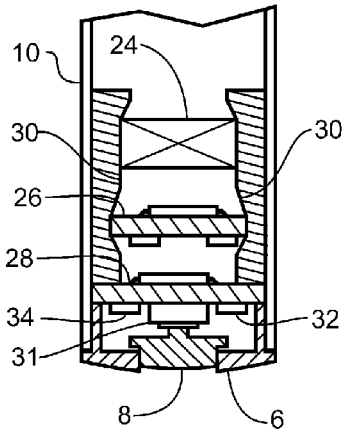
FIG. 6 is a tip end side section view detail drawing of an electronic cigarette according to an illustrative embodiment of the present invention.

Reference is directed to FIG. 6, which is a tip end side section view detail drawing of the electronic cigarette according to an illustrative embodiment of the present invention. FIG. 6 corresponds to the illustrative embodiment of FIGS. 4 and 5, and illustrates the structural arrangement of the draw pressure sensor 24, the main circuit board 26, the lamp circuit 28, and the interface with the tip end 6 and actuator 8. The first elongated portion of the housing 10 terminates with the tip end 6, which is fabricated from a translucent gray plastic, which emulates a tobacco cigarette ash color, and allows the internal lamps 32, 34 to illuminate the tip end 6 in their respective colors. In the illustrative embodiment, a first color lamp 32 is an amber light emitting diode, and a second color lamp 34 is a blue light emitting diode. Plural diodes may be employed to yield even tip 6 illumination. An actuator tip 8 is disposed on the tip 6, and is also fabricated tom a gray translucent plastic, thereby effectively concealing its presence. The actuator tip 8 engages a switch 31 located on the lamp control circuit board 28. Thusly, pressing the actuator tip 8 actuates the switch 31, and provides a user interface for control of the functions described herein. The lamp control circuit board 28 comprises the lamp 32, 34 interface circuitry. It accepts the aforementioned lamp signal and secondary function signals from the draw circuit and the secondary circuits. A simple microprocessor may also be employed in the lamp circuit to facilitate the described functionality, as will be appreciated by those skilled in the art. The lamp circuit board has the first color lamp 32 and the second color lamp 34 disposed on its surface.

With respect to the illustrative embodiment of FIGS. 4 through 6, the functionality will not be described. Given that there is an amber lamp and a blue lamp, there are three possible states; amber light, blue light, and off. Further, there are two separate driving signals; the lamp signal and the secondary function signal. The two drive signals are indications that a lamp may be illuminated to indicate the corresponding function of the signal. In the prior art, the draw signal illuminated the amber lamp indicating that a draw action was in progress and that the atomizer was operating in response thereto, and, the secondary signal also illuminated the amber lamp indicating other secondary function activity. Through utilization of the teaching of the present invention, it is now appreciated that the user can make alternative selections as to the response to the lamp signal and the secondary signal. In particular, the user can sequentially actuate the actuator to control the operation of the lamps in the presence of the draw signal. A default state is to illuminate the amber lamp in response to the lamp signal, most closely emulating a tobacco cigarette. A first actuation changes the lamp selection to illuminate the blue lamp, changing the appearance to clearly show it is not a tobacco cigarette. A second actuation changes the lamp selection such that neither lamp is illuminated, operating in a non-illuminated mode. Sequential actuations repeat the sequence, and so forth, providing a sequence of alternative lamp selections at the user's choice and discretion. In addition, the choice of operation in response to the secondary signal can be controlled. In particular, even though the lamps may not be illuminated in response to the lamp signal, they can still illuminate in response to the secondary signal. Further, the draw response may be a first color and the secondary response may be the second color, thereby distinguishing the different operations to the user. There is also a "stealth" mode, where no lamps are illuminated at all.

Figure 7C:
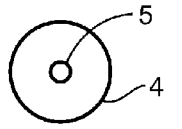
FIGS. 7*a*, 7*b*, and 7*c* are side section view, tip end view, and mouthpiece end view, respectively, drawings of an electronic cigarette according to an illustrative embodiment of the present invention.
Figure 7A:
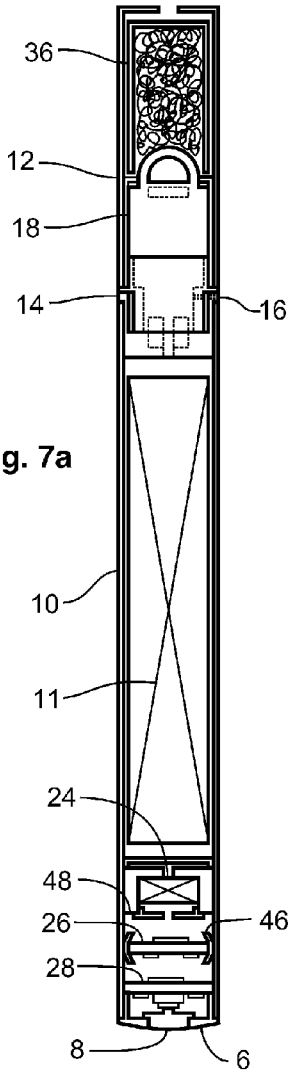
Figure 7B:
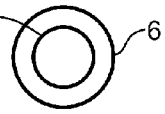
Figure 9:
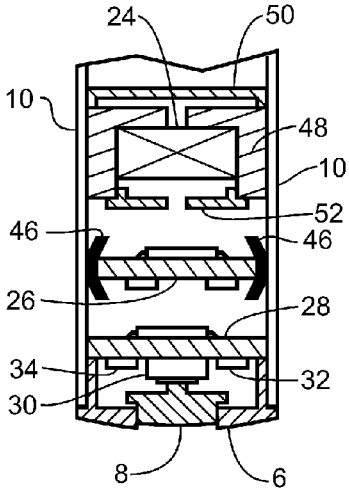
FIG. 9 is a tip end side section view detail view drawing of an electronic cigarette according to an illustrative embodiment of the present invention.
Figure 8:
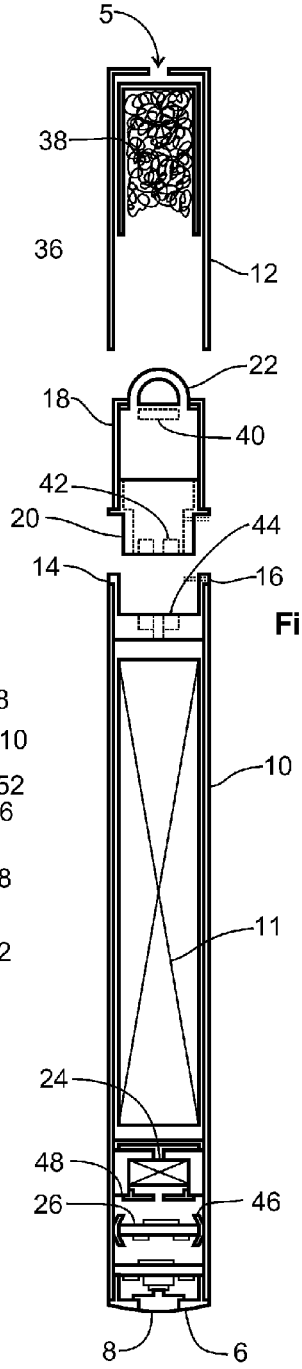
FIG. 8 is an exploded side section view drawing of an electronic cigarette according to an illustrative embodiment of the present invention.

Reference is directed to FIGS. 7*a*, 7*b*, and 7*c*, which are side section view, tip end view, and mouthpiece end view, respectively, drawings of an electronic cigarette according to an illustrative embodiment of the present invention. See also, FIG. 8, which is an exploded side section view drawing of an electronic cigarette corresponding to this illustrative embodiment. The components in these FIGS. 7 through 8 sharing like reference numerals with those components discussed with respect to FIG. 4 though 5 share like description, so they won't be repeated here. However, the support assembly and pneumatic coupling for the draw pressure sensor 24, main circuit board 26, and lamp circuit board 28 differ. In particular, reference is directed to FIG. 9, which is a tip end side section view detail view drawing of the electronic cigarette according to this illustrative embodiment of the present invention. The draw pressure sensor 24 is located in the first elongated housing portion 10 using a circumferential resilient surround 48 to pneumatically seal and isolate it from the housing 10. A front baffle plate 50 and a rear baffle plate 52 provide portals from the pneumatic coupling and routing of conductors, including the battery 11 leads, the heater 40 leads, and the draw pressure sensor 24 leads. The baffle plates 50, 52 are fabricated from a more rigid material to maintain shape. The main circuit board 26 is isolated from the first elongated portion of the housing 10 using a shrink-wrap membrane 46 selected to enable a press-fit, thereby supporting and electrically isolating the main circuit board 26. The structure of the lamp circuit 28, lamps 32, 34, switch 30, tip 6, and actuator 8 are substantially the same as in the prior illustrative embodiment.

Figure 10:
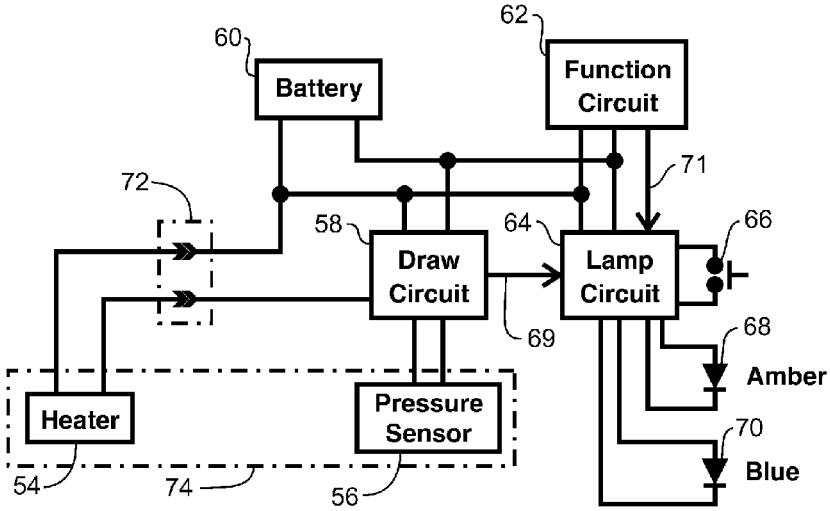
FIG. 10 is a functional block schematic diagram an electronic cigarette according to an illustrative embodiment of the present invention.

Reference is directed to FIG. 10, which is a functional block schematic diagram an electronic cigarette according to an illustrative embodiment of the present invention. The housing 74 is illustrated in phantom, and suggests the pneumatic coupling between the heater 54 in the atomizer and the draw pressure sensor 56, which enables the production of a draw signal as air is drawn out of the housing 74. The two portions of the housing are selectively coupled, so a pair of electrical contacts 72 couples the heater element 54 in the second elongated portion of the housing from the rest of the circuitry, which is located in the first elongated portion of the housing. A battery 60 provides power to the draw circuit 58, the function circuit 62, and the lamp circuit 64. The draw circuit 58 receives a signal from the pressure sensor 56, and in response produces the lamp signal 69, which is output to the lap circuit 64. The function circuit 62 generates the secondary signal 71, which is output to the lamp circuit 64 as well. The lamp circuit 64 also receives the actuator 66 signals, and results in driving the first amber lamp 68 and second blue lamp 70 according to the functions described hereinbefore.

Figure 11:
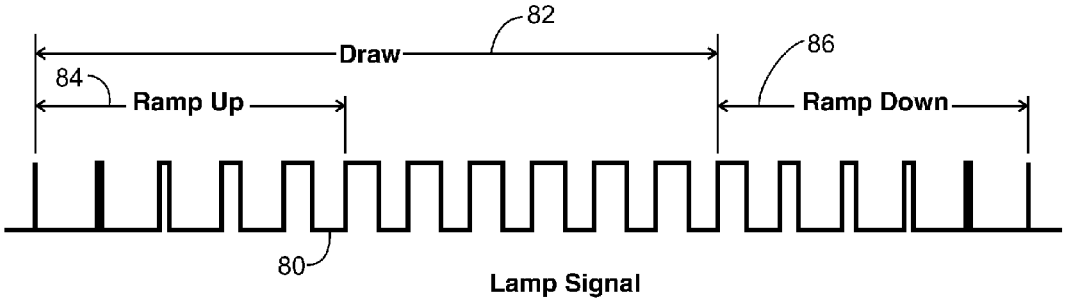
FIG. 11 is a signal diagram of a lap signal according to an illustrative embodiment of the present invention.

Reference is directed to FIG. 11 is a signal diagram of a lap signal according to an illustrative embodiment of the present invention. It will be appreciated that the lamp signal and the secondary function signal may take various forms and timing arrangements. The occurrence of the draw signal, lamp signal, and actual illumination of a lamp do not necessarily correspond in time. Also, it is useful to pulse-modulate the lamp illumination to manage electric power consumption and illumination characteristics. FIG. 11 is an example of this technique, where the lamp brightness increases and decreases gradually to more closely emulate a puff on a tobacco cigarette, and where the maximum brightness is a pulse train to limit maximum power consumption. More particularly, the lamp signal 80 is initiated at the beginning of the draw signal 82, and proceeds with a gradual ramp-up pulse width modulation sequence 84. Upon cessation of the draw signal 82, a ramp-down sequence of pulse width modulation 86 gradually dims the lamp signal.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An electronic cigarette apparatus for generating an aerosol of a fluid in response to air being drawn therethrough, comprising:

a housing having; a tip with a translucent portion, a mouthpiece with an aerosol outlet opening formed therethrough, and an electric power supply disposed therein;

a fluid reservoir, for containing the fluid;

an atomizer assembly coupled to receive the fluid from said fluid reservoir, and operable to selectively generate an aerosol of the fluid;

a draw pressure sensor pneumatically coupled to generate a draw signal in response to detection of a pressure change induced while air is drawn out of said aerosol outlet;

a draw control circuit operable to activate said atomizer assembly in response to said draw signal, thereby selectively outputting said aerosol to said aerosol output, and further operable to output a lamp signal in response to said draw signal;

a lamp circuit having an actuator, a first color lamp and a second color lamp, both aligned to illuminate said tip, and operable to selectively, and alternatively in response to subsequent actuations of said actuator, select between illuminating said first color lamp and said second color lamp in response to said lamp signal, and a secondary function circuit operable to output a secondary signal to said lamp circuit, and wherein said lamp circuit is operable to illuminate said first color lamp or said second color lamp in response to said secondary signal.

2. The apparatus of claim 1, and wherein:

said lamp circuit is further operable to selectively, and alternatively in response to subsequent actuations of said actuator, select between not illuminating and illuminating said first color lamp and said second color lamp in response to said lamp signal.

3. The apparatus of claim 1, and wherein:

said power supply is a rechargeable battery, and said secondary signal is indicative of low batter power status or battery charging status.

4. The apparatus of claim 1, and wherein:

said lamp circuit is further operable to selectively, and alternatively in response to subsequent actuations of said actuator, select between not illuminating and illuminating said first color lamp and said second color lamp in response to said lamp signal, and further comprising;

a secondary function circuit operable to output a secondary signal to said lamp circuit, and wherein said lamp circuit is further operable to illuminate said first color lamp or said second color lamp in response to said secondary signal regardless of state of said lamp signal and said selective and alternative actuator selection.

5. The apparatus of claim 1, and wherein:

said actuator is a second portion of said tip.

6. The apparatus of claim 5, and wherein:

said actuator is translucent.

7. The apparatus of claim 1, and wherein:

said first color lamp and said second color lamp are light emitting diodes.

8. The apparatus of claim 1, and wherein:

said first color lamp comprises plural amber color light emitting diodes, and said second color lamp comprises plural light emitting diodes of a color other than amber.

9. An electronic cigarette apparatus for generating an aerosol of a fluid in response to air being drawn therethrough, comprising:

a housing having; a tip with a translucent portion, a mouthpiece with an aerosol outlet opening formed therethrough, and an electric power supply disposed therein;

a fluid reservoir, for containing the fluid;

an atomizer assembly coupled to receive the fluid from said fluid reservoir, and operable to selectively generate an aerosol of the fluid;

a draw pressure sensor pneumatically coupled to generate a draw signal in response to detection of a pressure change induced while air is drawn out of said aerosol outlet;

a draw control circuit operable to activate said atomizer assembly in response to said draw signal, thereby selectively outputting said aerosol to said aerosol output, and further operable to output a lamp signal in response to said draw signal a lamp circuit having an actuator and a first color lamp aligned to illuminate said tip, and operable to selectively, and alternatively in response to subsequent actuations of said actuator, select between not illuminating and illuminating said first color lamp in response to said lamp signal, and a secondary function circuit operable to output a secondary signal to said lamp circuit, and wherein said lamp circuit is further operable to illuminate said first color lamp in response to said secondary signal regardless of state of said lamp signal and said selective and alternative actuator selection.

10. The apparatus of claim 9, and wherein:

said actuator is a second portion of said tip.

11. The apparatus of claim 10, and wherein:

said actuator is translucent.

12. The apparatus of claim 9, and wherein:

said first color lamp is a light emitting diode.

13. The apparatus of claim 9, and wherein:

said first color lamp comprises plural amber light emitting diodes.

* * * * *